US012589323B2

(12) United States Patent
Yang

(10) Patent No.: US 12,589,323 B2
(45) Date of Patent: Mar. 31, 2026

(54) AUTOMATIC BUBBLE MACHINE

(71) Applicant: Shantou Wintide Intelligent Technology Co., Ltd., Shantou (CN)

(72) Inventor: Shen Yang, Shantou (CN)

(73) Assignee: Shantou Wintide Intelligent Technology Co., Ltd., Shantou (CN)

( * ) Notice: Subject to any disclaimer, the term of this patent is extended or adjusted under 35 U.S.C. 154(b) by 171 days.

(21) Appl. No.: 18/652,231

(22) Filed: May 1, 2024

(65) Prior Publication Data

US 2024/0367071 A1 Nov. 7, 2024

(30) Foreign Application Priority Data

May 4, 2023 (CN) ..... 202321030087.8

(51) Int. Cl.
*A63H 33/28* (2006.01)

(52) U.S. Cl.
CPC ..... *A63H 33/28* (2013.01)

(58) Field of Classification Search
CPC ..... A63H 33/28
USPC ..... 446/15
See application file for complete search history.

(56) References Cited

U.S. PATENT DOCUMENTS

| | | | | |
|---|---|---|---|---|
| 8,272,916 | B2 * | 9/2012 | Thai | A63H 33/28 446/16 |
| 10,814,243 | B2 * | 10/2020 | Clayton | A63H 33/28 |
| 11,446,584 | B2 * | 9/2022 | Yang | A63H 33/28 |
| 2006/0052027 | A1 * | 3/2006 | Thai | A63H 33/28 446/15 |
| 2023/0135754 | A1 * | 5/2023 | Yang | A63H 33/28 446/15 |

* cited by examiner

*Primary Examiner* — Joshua D Huson
(74) *Attorney, Agent, or Firm* — Olive Law Group, PLLC

(57) ABSTRACT

The present utility patent discloses an automatic bubble machine, including a fixed back shell, a back shell body, a base body, a bubble spitting device, a battery box back cover and a fixed front shell, wherein one side of the fixed back shell is fixedly connected to the fixed front shell, bottoms of the fixed back shell and the fixed front shell are rotatably connected with a bubble water base, a battery box is embedded inside the fixed back shell, screw holes are arranged inside the back shell body, and corrugated stripe grooves and transverse grooves are arranged on outer wall of the back shell body. Users rotate top of the bubble machine to change bubble spitting methods and blow out bubbles in different shapes.

2 Claims, 5 Drawing Sheets

AUTOMATIC BUBBLE MACHINE

TECHNICAL FIELD

The present utility patent relates to the technical field of bubble machines, in particular to an automatic bubble machine.

BACKGROUND

When traditional bubble machine is in use, it cannot pump water automatically, and a plurality of bubble spitting rings of the bubble machine cannot spit out bubbles at the same time. Therefore, a large number of bubbles cannot be generated at the same time, which reduces overall fun of use. In addition, the traditional bubble machine cannot spit out bubbles by rotating top of the bubble machine, nor can it change bubble spitting methods to blow bubbles in different shapes.

Therefore, those skilled in the art provide an automatic bubble machine to solve the problems raised in the above background technology.

SUMMARY

The purpose of the present utility patent is to provide an automatic bubble machine to solve the problems existing in the use of the traditional bubble machine proposed in the above background technology. The bubble machine of the present utility patent can automatically pump water when in use, and a plurality of bubble spitting rings of the bubble machine can blow out bubbles at the same time. Therefore, a large number of bubbles can be generated at one the same time, which increases the fun of use. In addition, a rotating disc is arranged at top surface of the base of the bubble machine of the present utility patent, so that top of the bubble machine can be rotated to blow out bubbles, and bubbles in different shapes can be blown out by rotating and changing the methods of generating bubbles.

In order to achieve the above purpose, the present utility patent provides the following technical solutions: an automatic bubble machine, including a fixed back shell, a back shell body, a base body, a bubble spitting device, a rotating block, a battery box back cover and a fixed front shell, wherein one side of the fixed back shell is fixedly connected with the fixed front shell, bottoms of the fixed back shell and fixed front shell is rotatably connected with a bubble water base, a battery box is embedded inside the fixed back shell, screw holes are arranged inside the back shell body, corrugated stripe grooves and transverse grooves are arranged on outer wall of the back shell body, decorative anti-slip blocks are arranged on outer wall of the base body, a rotating disc is arranged on top surface of the base body, anti-slip stripes are arranged on outer wall of the rotating disc, a sealing ring is arranged on top surface of the rotating disc, a connecting hose is inserted into the rotating block, one end of the connecting hose is fixedly connected with a driver and bubble spitting rings, one end of the driver is fixedly connected with a connecting disc, other end of driver is fixedly connected with a connecting fan, a screw mounting block is arranged on top surface of the connecting disc, front side surface of the connecting disc is provided with a mark block and bubble spitting rings, power supply batteries are embedded inside the battery box back cover, connecting wire pieces A are arranged on top surface of the power supply batteries, connecting wire pieces B are arranged on bottom surface of the power supply batteries, a wire fixing block is embedded on inner wall of the battery box back cover.

Preferably, the fixed back shell includes a back shell body, screw holes, corrugated stripe grooves and transverse grooves.

Preferably, the corrugated stripe grooves and transverse grooves are provided with two sets, and two sets of corrugated stripe grooves are arranged symmetrically at top and bottom of the battery box, and two sets of transverse grooves are arranged symmetrically on both sides of the battery box.

Preferably, the bubble water base includes a base body, decorative anti-slip blocks, a rotating disc, anti-slip stripes and a sealing ring.

Preferably, the bubble spitting device includes the rotating block, the mark block, bubble spitting rings, the connecting disc, the screw mounting block, the driver, the connecting fan and the connecting hose.

Preferably, the battery box includes a battery box back cover, power supply batteries, connecting wire pieces A, connecting wire pieces B and the wire fixing block.

Compared with the prior art, the beneficial effects of the present utility patent are:

the present utility patent provides an automatic bubble machine which can change the shortcoming of the traditional bubble machine that cannot automatically pump water when in use. At the same time, it achieve the effect that a plurality of bubble spitting rings of the bubble machine can generate bubbles at the same time. Generating a large number of bubbles at the same time increases the overall fun; in addition, the user can rotate the top of the bubble machine to change the bubble generating methods, and blow out bubbles in different shapes.

BRIEF DESCRIPTION OF DRAWINGS

By reading the detailed description of the non-limiting embodiments with reference to the following drawings, other features, purposes and advantages of the present utility patent will become more apparent.

Figure 1:
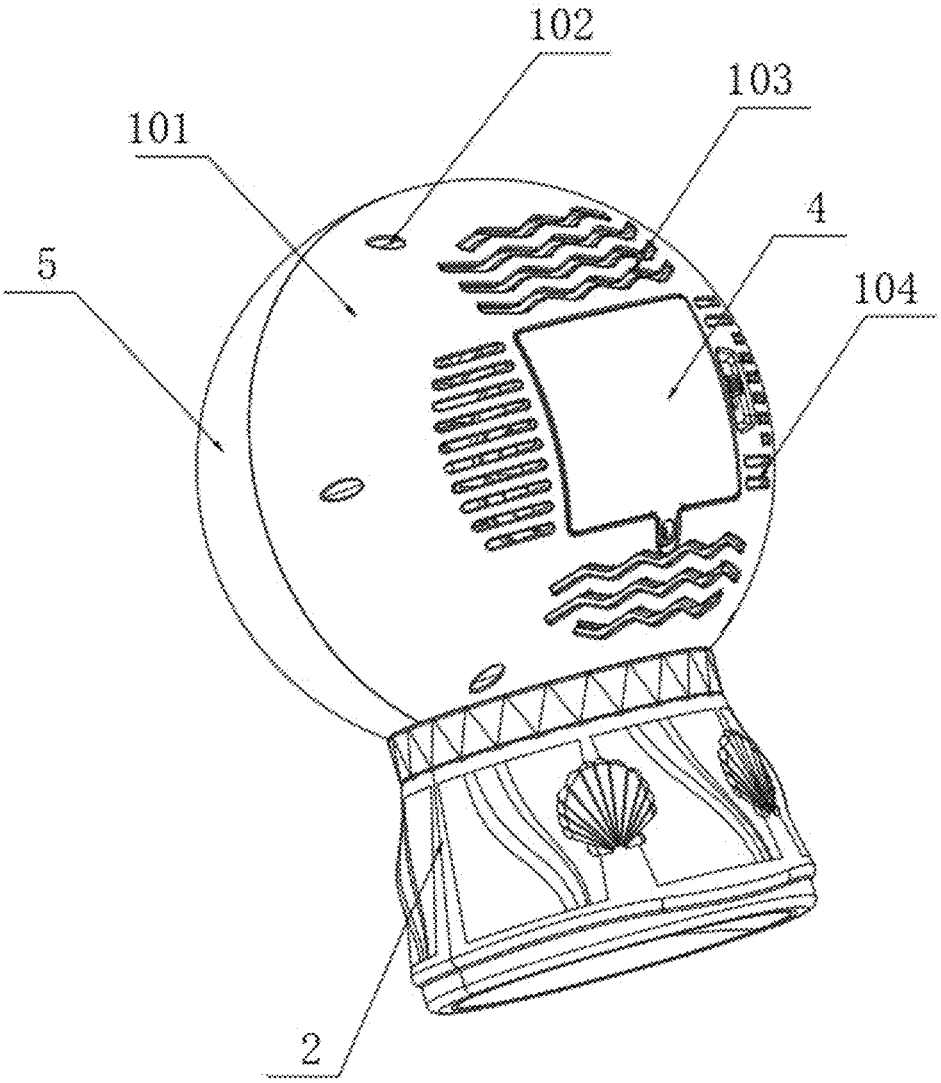
FIG. 1 is a schematic diagram of the overall three-dimensional structure of an automatic bubble machine.
Figure 2:
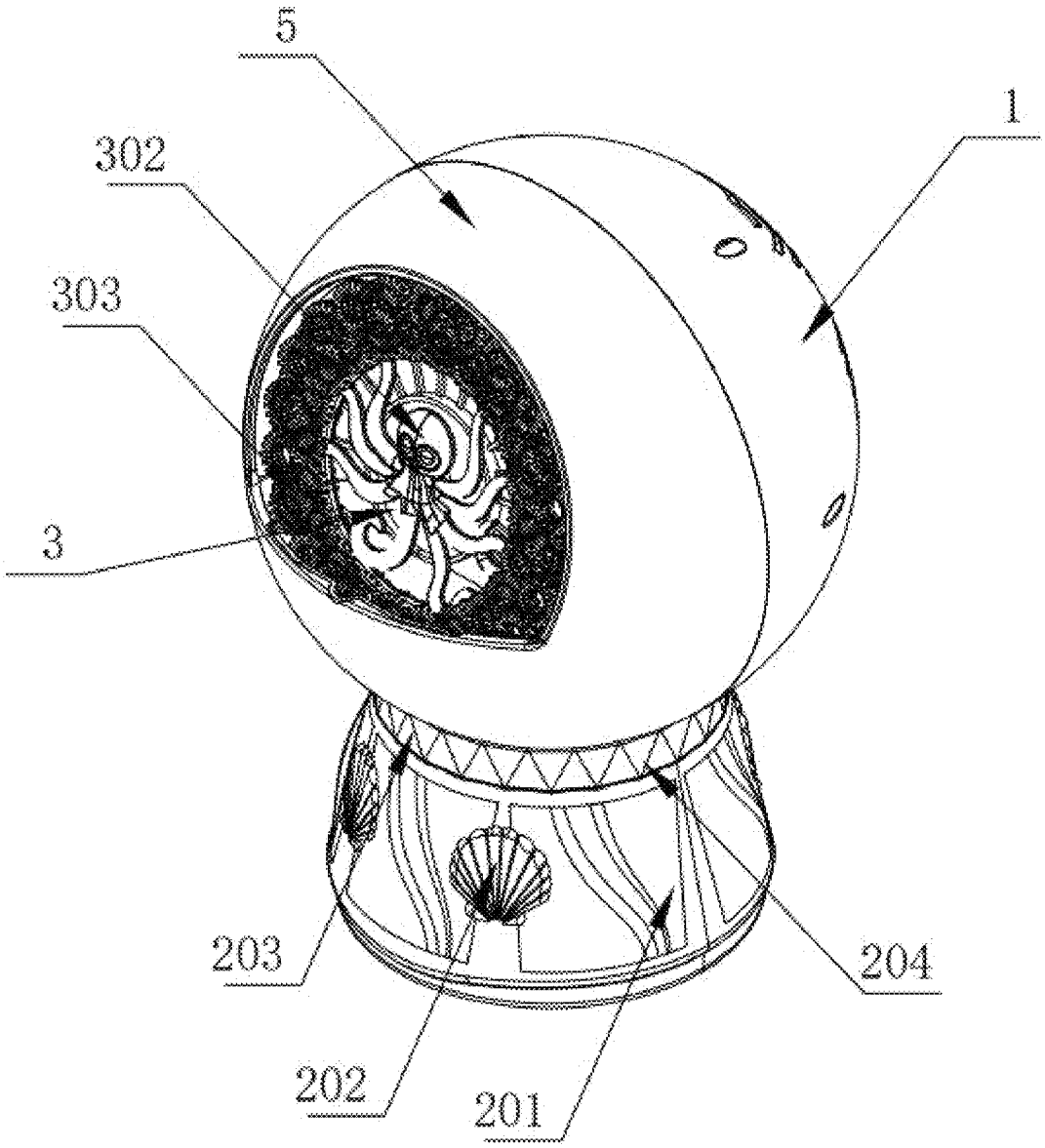
FIG. 2 is a schematic structural diagram of the overall isometric side view of an automatic bubble machine.

Reference signs in the drawings: 1. fixed back shell; 101. back shell body; 102. screw hole; 103. corrugated stripe groove; 104. transverse groove; 2. bubble water base; 201. base body; 202. decorative anti-slip block; 203. rotating disc; 204. anti-slip stripe; 205. sealing ring; 3. bubble spitting device; 301. rotating block; 302. mark block; 303. bubble spitting ring; 304. connecting disc; 305. screw mounting block; 306, driver; 307, connecting fan; 308, connecting hose; 4, battery box; 401, battery box back cover; 402, power supply battery; 403, connecting wire piece A; 404, connecting wire piece B; 405. wire fixing block; 5. fixed front shell.

DESCRIPTION OF EMBODIMENTS

Referring to FIGS. 1 to 5, in the embodiment of the present utility patent, an automatic bubble machine includes a fixed back shell 1, a back shell body 101, a base body 201, a bubble spitting device 3, a rotating block 301, and a battery box back cover 401 and a fixed front shell 5, wherein the fixed front shell 5 is fixedly connected to one side of the fixed back shell 1. Bottom surfaces of the fixed back shell 1 and the fixed front shell 5 are rotationally connected with a bubble water base 2, which can change the disadvantage of the traditional bubble machine that it cannot pump water automatically when in use, and achieve the effect that a plurality of bubble spitting rings of the bubble machine can generate bubbles at the same time. Generating a large number of bubbles at the same time increases the overall fun. The battery box 4 is embedded inside the fixed back shell 1. Screw holes 102 is arranged inside the back shell body 101. Corrugated stripe grooves 103 and transverse grooves 104 are arranged on outer wall of the back shell body 101. The corrugated stripe grooves 103 and the transverse grooves 104 plays a role in ventilation. The screw holes 102 are convenient for the fixed installation of the fixed back shell 1 and the fixed front shell 5. The interior of the base body 201 is filled with bubble water, and outer wall of the base body 201 is provided with decorative anti-slip blocks 202 to play a role in anti-slip and decoration. Top surface of the base body 201 is provided with a rotating disc 203. Outer wall of the rotating disc 203 is provided with anti-slip stripes 204. Top surface of the rotating disc 203 is provided with a sealing ring 205. A connecting hose 308 is inserted into the rotating block 301. Under the action of the rotating disc 203 and the anti-slip stripes 204, the rotating block 301 and the sealing ring 205 can rotate 360 degrees. The connecting hose 308 can suck the bubble water out of the base body 201, and then spit out the bubbles through the bubble spitting rings 303. Under the action of the driver 306 and the connecting fan 307, it has a effect of generating bubbles. One end of the connecting hose 308 is fixedly connected to the driver 306 and the bubble spitting rings 303. One end of the driver 306 is fixedly connected to the connecting disc 304. Other end of the driver 306 is fixedly connected to the connecting fan 307. Top surface of the connecting disc 304 is provided with a screw mounting block 305. Front side of the connection disc 304 is provided with a mark block 302 and bubble spitting rings 303. Power supply batteries 402 are embedded inside the battery box back cover 401, Top surface of the power supply batteries 402 is provided with connecting wire pieces A 403, and bottom surface of the power supply batteries 402 A is provided with connecting wire pieces B 404, and a wire fixing block 405 is embedded on inner wall of the battery box back cover 401.

Figure 3:
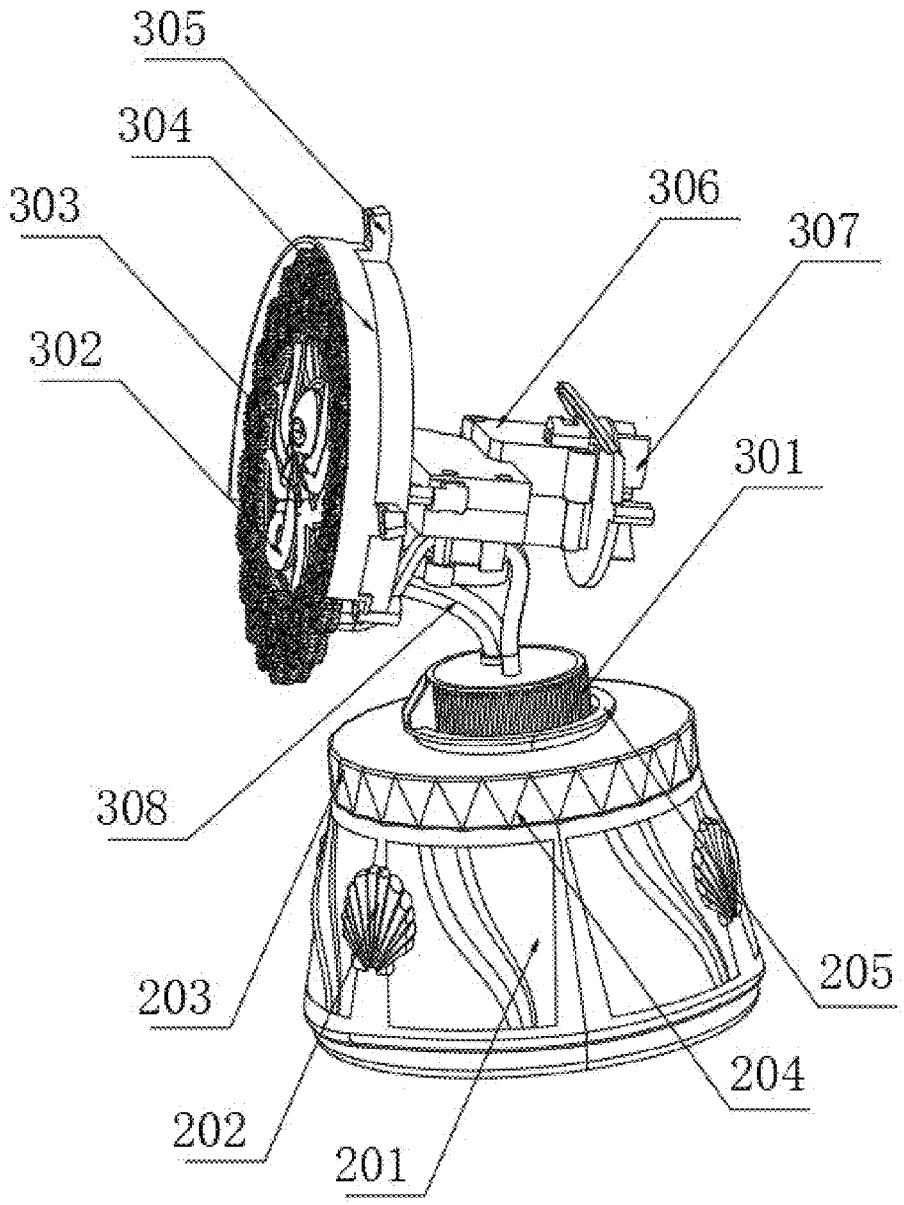
FIG. 3 is a schematic diagram of the internal three-dimensional structure of an automatic bubble machine.
Figure 4:
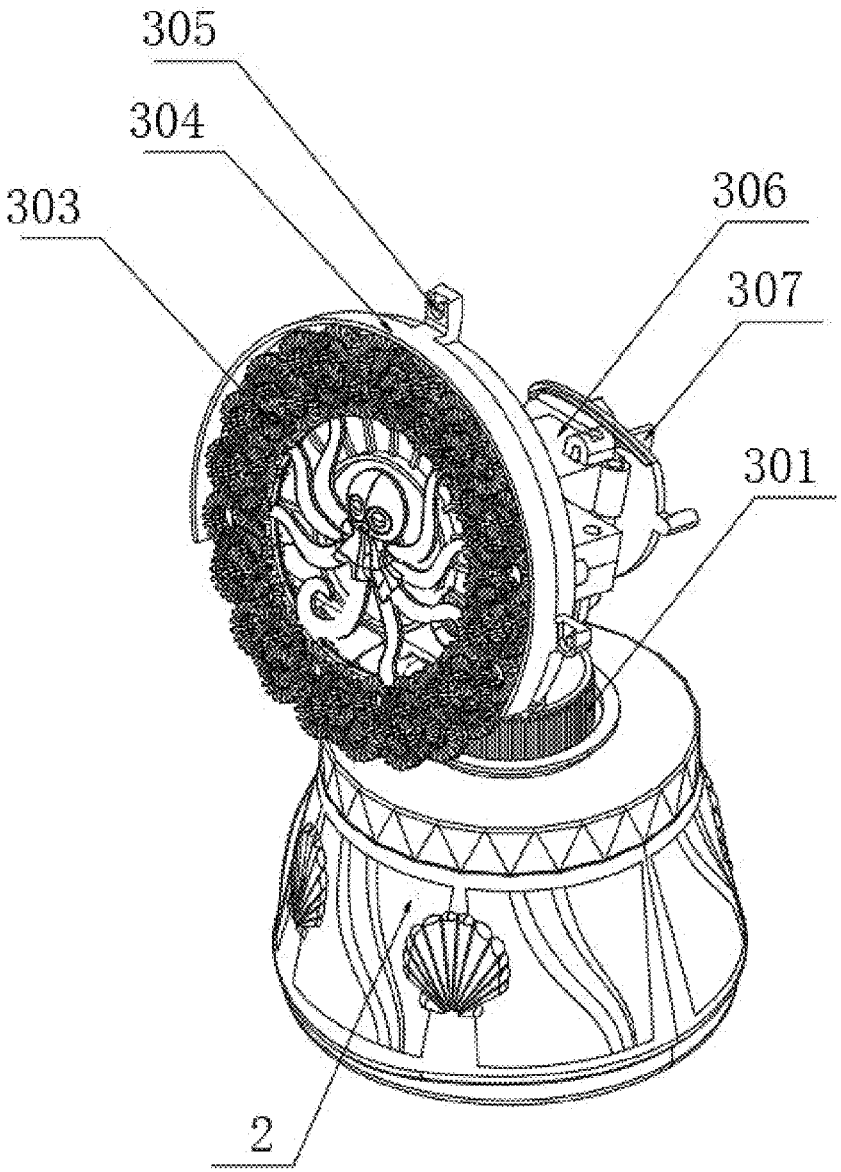
FIG. 4 is a schematic structural diagram of an internal three-dimensional isometric side view of an automatic bubble machine.
Figure 5:
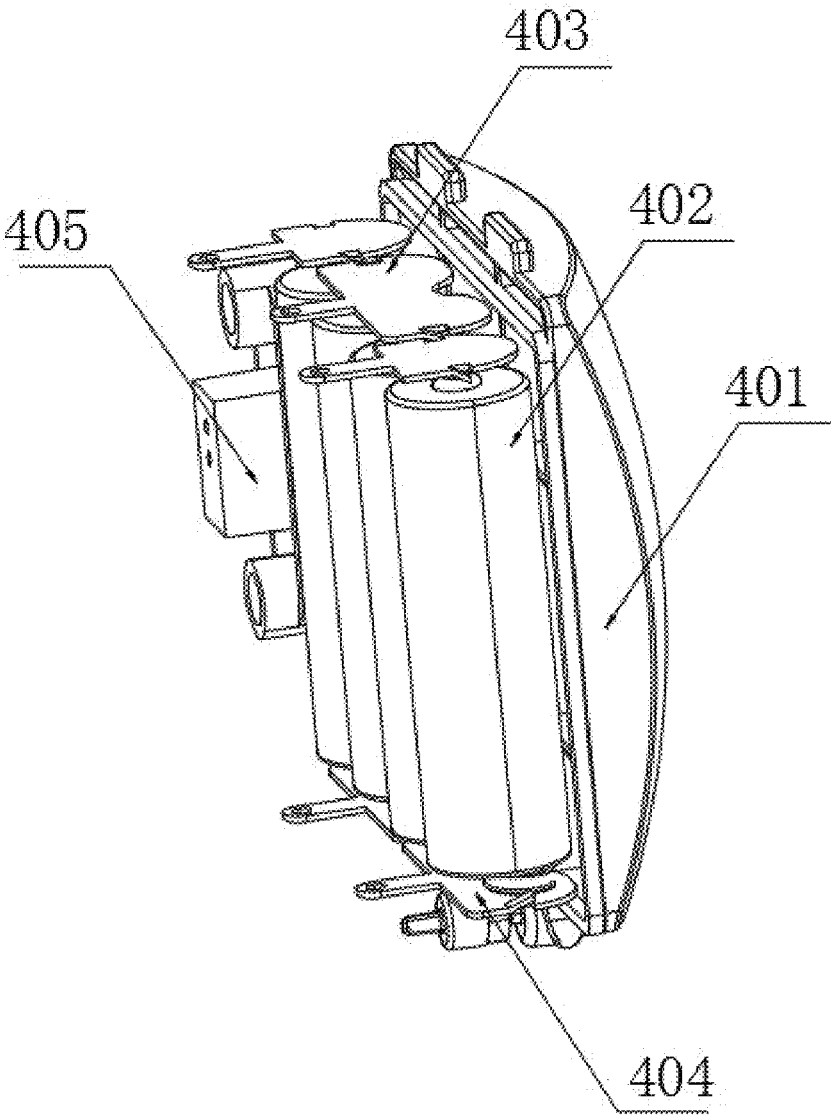
FIG. 5 is a schematic diagram of the three-dimensional structure of a battery box in an automatic bubble machine.

Referring to FIGS. 1, 3 and 5, the fixed back shell 1 includes the back shell body 101, screw holes 102, corrugated stripe grooves 103 and transverse grooves 104. Wires can be electrically connected through the connecting wire pieces A 403 and the connecting wire pieces B 404. The battery box back cover 401 plays a role of sealing for the fixed back shell 1. The corrugated stripe grooves 103 and the transverse grooves 104 are provided with two sets, two sets of corrugated stripe grooves 103 are distributed symmetrically on top and bottom of the battery box 4, and two sets of transverse grooves 104 are distributed symmetrically on both sides of the battery box 4. The bubble water base 2 includes a base body 201, decorative anti-slip blocks 202, a rotating disc 203, anti-slip stripes 204 and a sealing ring 205. When in use, the user rotates top of the bubble machine to make the bubble machine spit out bubbles. The rotation can change the bubble generating methods and blow out bubbles in different shapes. The bubble spitting device 3 includes a rotating block 301, a mark block 302, bubble spitting rings 303, a connecting disc 304, a screw mounting block 305, a driver 306, a connecting fan 307 and a connecting hose 308. The battery box 4 includes a battery box back cover 401, power supply batteries 402, connecting wire pieces A 403, connecting wire pieces B 404 and a wire fixing block 405.

It should be noted that the present utility patent provides an automatic bubble machine, which includes: fixed back shell 1; back shell body 101; screw holes 102; corrugated stripe groove 103; transverse groove 104; bubble water base 2; base body 201; decorative anti-slip block 202; rotating disc 203; anti-slip stripe 204; sealing ring 205; bubble spitting device 3; rotating block 301; mark block 302; bubble spitting ring 303; connecting disc 304; screw mounting block 305; driver 306; connecting fan 307; connecting hose 308; battery box 4; battery box back cover 401; power supply battery 402; connecting wire piece A 403; connecting wire piece B 404; wire fixing block 405; fixed front shell 5. The parts are all universal standard parts or known to those skilled in the art, and their structures and principles can learn from the technical manual or through routine experimental methods for those skilled in the art.

The working principle of the present utility patent is: different from the traditional bubble machine, the bubble machine of the present utility patent achieves the function of automatic water intake. When in use, the bubble machine can achieve the effect that a plurality of bubble spitting rings spit out bubbles at the same time, so that it can generate a large number of bubbles at the same time, increasing the overall fun. The corrugated stripe grooves 103 and the transverse grooves 104 play a role in ventilation. The screw holes 102 facilitate the fixed installation of the fixed back shell 1 and the fixed front shell 5. The interior of the base body 201 is filled with bubble water for ease of use. The decorative anti-slip blocks 202 play a role in anti-slip and decoration. Under the action of the rotating disc 203 and the anti-slip stripes 204, a rotation of 360 degrees can be achieved between the rotating block 301 and the sealing ring 205. The connecting hose 308 sucks out the bubble water from the base body 201, and then spits out the bubbles through the bubble spitting rings 303. The bubbles are blown out under the action of the driver 306 and the connecting fan 307, and the connecting wire pieces A 403 and the connecting wire pieces B 404 are connected to the wire for power supply. The battery box back cover 401 can seal the fixed back shell 1. When in use, the user rotates the top of the bubble machine to make the bubble machine spit out bubbles in different directions. In addition, the rotation can change the bubble spitting methods and blow out bubbles in different shapes.

The above are only preferred specific embodiments of the present utility patent, but the protection scope of the present utility patent is not limited thereto. In the technical scope disclosed by the present utility patent, any technician familiar with the technical field makes equivalent substitutions or changes based on the technical solution of the present utility patent and its utility patent concept, which should be covered by the protection scope of the present utility patent.

What is claimed is:

1. An automatic bubble machine, comprising a fixed back shell, a back shell body, a base body, a bubble spitting device, a rotating block, a battery box back cover and a fixed front shell, wherein one side of the fixed back shell is fixedly connected with the fixed front shell, bottoms of the fixed back shell and fixed front shell is rotatably connected with a bubble water base, a battery box is embedded inside the fixed back shell, screw holes are arranged inside the back shell body, corrugated stripe grooves and transverse grooves are arranged on outer wall of the back shell body, decorative anti-slip blocks are arranged on outer wall of the base body, a rotating disc is arranged on top surface of the base body, anti-slip stripes are arranged on outer wall of the rotating disc, a sealing ring is arranged on top surface of the rotating disc, a connecting hose is inserted into the rotating block, one end of the connecting hose is fixedly connected with a driver and bubble spitting rings, one end of the driver is fixedly connected with a connecting disc, other end of driver is fixedly connected with a connecting fan, a screw mounting block is arranged on top surface of the connecting disc, front side surface of the connecting disc is provided with a mark block and bubble spitting rings, power supply batteries are embedded inside the battery box back cover, connecting wire pieces A are arranged on top surface of the power supply batteries, connecting wire pieces B are arranged on bottom surface of the power supply batteries, a wire fixing block is embedded on inner wall of the battery box back cover.

2. The automatic bubble machine according to claim 1, wherein the corrugated stripe grooves and transverse grooves are provided with two sets, two sets of corrugated stripe grooves are arranged symmetrically on top and bottom of the battery box, and two sets of transverse grooves are arranged symmetrically on both sides of the battery box.

* * * * *